United States Patent [19]

Takahashi et al.

[11] 4,293,641

[45] Oct. 6, 1981

[54] PHOTOGRAPHIC LIGHT-SENSITIVE MATERIAL

[75] Inventors: Osamu Takahashi; Shinji Sakaguchi, both of Minami-ashigara, Japan

[73] Assignee: Fuji Photo Film Co., Ltd., Kanagawa, Japan

[21] Appl. No.: 143,232

[22] Filed: Apr. 24, 1980

[30] Foreign Application Priority Data

Apr. 27, 1979 [JP] Japan ..... 54-52113

[51] Int. Cl.[3] ..... G03C 1/76

[52] U.S. Cl. ..... 430/502; 430/223; 430/359; 430/504; 430/537

[58] Field of Search ..... 430/502, 504, 551, 537, 430/223, 359

[56] References Cited

U.S. PATENT DOCUMENTS

| | | | |
|---|---|---|---|
| 2,403,721 | 7/1946 | Jelley et al. | 430/551 |
| 3,615,542 | 10/1971 | Oguchi et al. | 430/537 |
| 3,700,453 | 10/1972 | Knechel | 430/504 |
| 3,765,893 | 10/1973 | Lohmer | 430/504 |
| 3,982,944 | 9/1976 | Ohi et al. | 430/551 |

*Primary Examiner*—J. Travis Brown

*Attorney, Agent, or Firm*—Sughrue, Mion, Zinn, Macpeak & Seas

[57] ABSTRACT

A photographic light-sensitive material is described comprising a support having thereon at least two silver halide photographic emulsion layers capable of forming a silver image upon treatment with an alkaline processing solution in the presence of a developing agent for silver halide after exposure, said material containing an interlayer positioned between said emulsion layers, wherein the improvement comprises said interlayer containing a complex which is formed from a mixture of hydroquinone derivatives having a solidifying point of 100° C. or less, and which are different compounds from the developing agent for silver halide used in the treatment of the material, and a homopolymer or copolymer containing a recurring unit represented by formula (I):

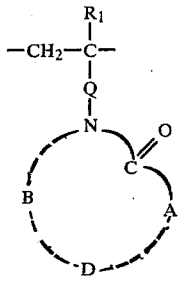

(I)

wherein $R_1$ represents a hydrogen atom or a methyl group; Q represents of chemical bond, —$COOR_2$— or —$CONHR_2$—; A represents a chemical bond or an oxygen atom; B represents a chemical bond or

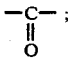

D represents —CH=CH)$_2$ or —$CH_2)_n$, wherein n represents an integer of 3 to 5 when A and B are both chemical bonds, an integer of 2 or 3 when A is an oxygen atom and B is a chemical bond, or an integer of 2 to 4 when A is a chemical bond and G is

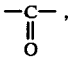

or D represents

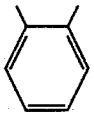

when A is a chemical bond and B is

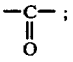

and $R_2$ represents a substituted or unsubstituted divalent hydrocarbon group having 2 to 8 carbon atoms.

The photographic light-sensitive material provides color images having excellent color separation.

25 Claims, No Drawings

PHOTOGRAPHIC LIGHT-SENSITIVE MATERIAL

BACKGROUND OF THE INVENTION

1. Field of the Invention

The present invention relates to a photographic light-sensitive material, particularly to a multi-layer color photographic light-sensitive material. More particularly, it relates to an interlayer having the property of substantially preventing color mixing, thereby improving the color separation property of the material.

2. Description of the Prior Art

In a photographic light-sensitive material for a color diffusion transfer process in which a photographic light-sensitive material containing a compound which releases a diffusible dye upon redox reaction induced by development of exposed silver halide (diffusible dye releasing type redox compound) is developed with a black and white developing agent, for example, phenidone, the oxidation product of the developing agent formed by development of silver halide should desirably react only with a dye releasing redox compound associated therewith. Therefore, it has been known that a layer containing a color mixing preventing agent, that is, a substance which is capable of reacting appropriately with the oxidation product of a developing agent, for example, a hydroquinone derivative, is provided in the light-sensitive material for the purpose of preventing the oxidation product of a developing agent from diffusing into a layer containing a dye releasing redox compound which is not connected therewith, as described in *Research Disclosure,* Vol. 152, No. 15162 (November, 1976).

Alkyl hydroquinones and di-alkyl hydroquinones are well known as hydroquinone derivatives for preventing color mixing. In particular, it is known that a mixture of hydroquinone derivatives as described in Japanese Patent Application (OPI) 2128/71 (The term "OPI" as used herein refers to a "published unexamined Japanese patent application".) has a melting point of 100° C. or less and most of them are liquid or waxen. Thus a high boiling solvent (oil) for dispersion thereof is not necessary in order to obtain a stable dispersion thereof. That is, such hydroquinone derivatives do not crystallize from the dispersion in a hydrophilic colloid layer before, during, or after coating in the absence of a high boiling solvent (oil) for dispersion.

Disadvantageously, however, since most mixtures of hydroquinone derivatives are liquid at room temperature, various undesirable secondary effects accompany their use. For example, one such effect is the migration of the mixture into other layers of a multi-layer color photographic light-sensitive material; another is the migration of components dispersed in other layers into a layer for preventing color mixing containing such hydroquinone derivatives. These secondary effects are the same difficulties frequently observed generally when a high boiling solvent (oil) is incorporated into a light-sensitive material, namely, a decrease in stability during storage (also referred to as "shelf life") of the light-sensitive material (due to mixing occurring between layers due to the storage under relatively high temperature conditions, etc.), a decrease in adhesion between layers, and migration of the oily hydroquinone derivatives to a surface of the light-sensitive material. In particular, where the ratio of the amount of the hydrophilic colloid binder (for example, gelatin) to the amount of the liquid mixture hydroquinone derivatives becomes small, such tendencies increase, which is necessarily an obstacle to the desirable goal of decreasing the thickness of the photographic material. These problems occur not only in photographic light-sensitive materials for color diffusion transfer processes, but also in conventional color photographic light-sensitive materials in which color couplers, etc. are used.

Although it is known that a solid hydroquinone derivative (not a liquid mixture) and the polymer used in the present invention form a solid complex through hydrogen bonds, as described in Japanese patent application (OPI) 41633/72.

SUMMARY OF THE INVENTION

An object of the present invention is, therefore, to provide a photographic light-sensitive material having an improved interlayer for preventing color mixing, by which the problems occurring in the art, for example, the migration of a mixture of hydroquinone derivatives (acting as a liquid color mixing preventing agent) into other layers of the photographic material, or the migration of alien substances from other layers into the interlayer to hinder the function of the color mixing preventing agent, are overcome.

As a result of further investigations, it has now been found that the above object is effectively accomplished by a photographic light-sensitive material comprising a support having thereon at least two silver halide emulsion layers capable of forming a silver-image upon treatment with an alkaline processing solution in the presence of a developing agent for silver halide after exposure, said material containing an interlayer positioned between said emulsion layers, said interlayer containing a solid complex dispersed threin which is formed from a mixture of hydroquinone derivatives having a solidifying point of 100° C. or less, which are different compounds from the developing agent for silver halide used in the treatment of the material, and a homopolymer or copolymer containing a recurring unit represented by the formula (I) described below (hereinafter referred to as a polymer used in the present invention):

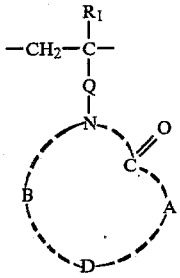

(I)

wherein $R_1$ represents a hydrogen atom or a methyl group; Q represents a chemical bond, $—COOR_2—$ or $—CONHR_2—$; A represents a chemical bond or an oxygen atom; B represents a chemical bond or $$—\underset{\underset{O}{\|}}{C}—;$$

D represents $—CH{=}CH_2$ or $—CH_{2n}$, wherein n represents an integer of 3 to 5 when A and B are both chemical bonds, an integer of 2 or 3 when A is an oxygen atom and B is a chemical bond, or an integer of 2 to 4 when A is a chemical bond and B is

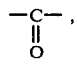

or D represents

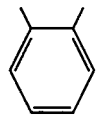

when A is a chemical bond and B is

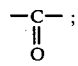

and $R_2$ represents a substituted or unsubstituted divalent hydrocarbon group having 2 to 8 carbon atoms.

Use of an interlayer according to the present invention provides a photographic light-sensitive material having reduced thickness and excellent photographic properties, e.g., color images having excellent color separation. The fact that an mixture which is essentially hard to solidify is immobilized upon the reaction with the polymer used according to the invention is completely novel and surprising.

DETAILED DESCRIPTION OF THE INVENTION

Examples of the mixtures of hydroquinone derivatives (color mixing preventing agents) used in the present invention include isomer mixtures of branched chain alkyl hydroquinone. Example of such isomer mixtures include those containing mixtures of hydroquinone compounds in which two tertiary alkyl groups having 15 carbon atoms are substituted at the 2- and 5-positions or the 2- and 6-positions of the benzene ring, as described in Japanese Patent Application 95256/77, and isomer mixtures of secondary dodecyl hydroquinones, as described in Japanese patent application (OPI) 2128/71.

A mixture of hydroquinone derivatives which have the ability of developing silver halide can be used in the present invention, in that the mixtures are substantially isolated in the form of an immobile solid complex which is formed from the mixture and the polymer used in the present invention, and which remains so even when the solid complex is contacted with an alkaline processing solution. However, mixtures having a color mixture preventing ability, but not having the ability to develop silver halide are preferred. Therefore, the isomer mixtures of branched chain alkyl hydroquinones specifically illustrated above are preferred.

The mixtures of hydroquinone derivatives which are used in the present invention having a solidifying point below 60° C. are preferred and those which are liquid or waxen at room temperature are particularly preferred.

The polymer used in the present invention can be a homopolymer of one monomer represented by the general formula (IA) described below, a copolymer of two or more monomers represented by the formula (IA), or a copolymer of at least one monomer represented by the formula (IA) and at least one unsaturated compound copolymerizable therewith:

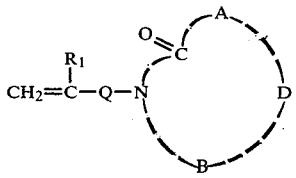

(IA)

wherein $R_1$, Q, A, B and D each has the same meansing as defined in formula (I) above.

Examples of the monomers represented by the general formula (I) include N-vinyl lactams, N-vinyl imides, N-acryloyloxyalkyl lactams, N-acryloyloxyalkyl imides, N-methacryloyloxyalkyl lactams, N-methacryloyloxyalkyl imides, N-(acrylamidoalkyl)lactams, N-(acrylamidoalkyl)imides, N-(methacrylamidoalkyl)-lactams, N-(methacrylamidoalkyl)imides, and so forth.

Specific examples of the monomers are, for example, N-vinyl-ε-caprolactam, N-vinyl piperidone, N-vinyl pyrrolidone, N-vinyl oxagolidone, N-vinyl-2-pyridone, N-vinyl succinimide, N-vinyl glutarimide, N-vinyl adipimide, N-vinyl phthalimide, N-(2-acryloyloxyethyl)pyrrolidone, N-(2-acryloyloxyethyl)-oxazolidone, N-(2-acryloyloxyethyl)succinimide, N-(2-methacryloyloxyethyl)pyrrolidone, N-(2-methacryloyloxyethyl)-succinimide, N-(2-acrylamidoethyl)pyrrolidone, N-(2-acrylamidoethyl)succinimide, N-(2-methacrylamidoethyl)succinimide, etc.

Examples of addition polymerizable unsaturated compounds which can form copolymers with the monomers represented by the formula (IA) include, for example, acrylic acid esters, methacrylic acid esters, acrylamides, methacrylamides, allyl compounds, vinyl ethers, vinyl esters, vinyl heterocyclic compounds, styrenes, maleic acid esters, fumaric acid esters, itaconic acid esters, crotonic acid esters, olefins, etc.

Specific examples of such comonomers are methyl acrylate, ethyl acrylate, n-propyl acrylate, isopropyl acrylate, n-butyl acrylate, octylacrylate, 2-chloroethyl acrylate, 2-cyanoethyl acrylate, N-(β-dimethylaminoethyl) acrylate, benzyl acrylate, cyclohexyl acrylate, phenyl acrylate; methyl methacrylate, ethyl methacrylate, n-propyl methacrylate, isopropyl methacrylate, n-butyl methacrylate, octyl methacrylate, cyclohexyl methacrylate, benzyl methacrylate; N-ethylacrylamide, N-(tert-butyl)acrylamide, N-(1,1-dimethyl-3-oxobutyl-)acrylamide, N-(1,1-dimethyl-3-hydroxybutyl)acrylamide, N-benzylacrylamide, β-dimethylaminoethylacrylamide, N,N-diethylacrylamide, N-acryloylmorpholine, N-acryloylpiperidine, N-(β-morpholinoethyl)-acrylamide; N-(tert-butyl)methacrylamide, N-benzylmethacrylamide, N,N-diethylmethacrylamide, N-methacryloylpiperidine; allyl acetate, allyl caprylate, allyl caproate, allyl laurate, allyl benzoate, allyl butyl ether, allyl phenyl ether; methyl vinyl ether, butyl vinyl ether, octyl vinyl ether, methoxyethyl vinyl ether, 2-chloroethyl vinyl ether, 2-hydroxyethyl vinyl ether, (2-dimethylaminoethyl)vinyl ether, vinyl phenyl ether, vinyl tolyl ether, vinyl chlorophenyl ether; vinyl acetate, vinyl propionate, vinyl butyrate, vinyl isobutyrate, vinyl caproate, vinyl chloroacetate, vinyl methoxyacetate, vinyl phenylacetate, vinyl acetoacetate, vinyl lactate, vinyl benzoate, vinyl chlorobenzoate, vinyl naphthoate; vinylpyridine, N-vinylimidazole, N-vinylcarbazole, vinylthiophene; styrene, chloromethylstyrene, p-acetoxystyrene, p-methylstyrene, p-vinylbenzoic acid, methyl p-vinylbenzoate; crotonic acid amide, butyl crotonate, glycerol monocrotonate, methyl vinyl ketone, phenyl vinyl ketone; ethylene, propylene, 1-butene, 4-methyl-1-hexene, 4,4-dimethyl-1-pentene; methyl itaconate, ethyl itaconate, diethyl itaconate; methyl sorbate; ethyl maleate, butyl maleate, dibutyl maleate, octyl maleate; ethyl fumarate, dibutyl fumarate, octyl fumarate; halogenated olefins, for example, vinyl chloride, vinylidene chloride, chloroprene, etc.; unsaturated nitriles, for example, acrylonitrile, methacrylonitrile, etc. If desired, two or more kinds of these monomers may be used in combination.

Of these monomers, considering properties such as solubility, oleophilicity, affinity for the protective colloid, development processing ability of the polymer, etc., the preferred monomers are N-vinyl lactams, N-vinyl imides and N-vinyl oxazolidones. N-vinyl pyrrolidone and N-vinyl succinimide are particularly preferred as the monomers represented by the formula (IA). Also, acrylic acid esters, methacrylic acid esters, vinyl esters, acrylamides and methacrylamides are preferred as the addition polymerizable unsaturated compounds which can form copolymers together with the monomer represented by the formula (IA).

There is no particular restriction on the component ratio of the copolymer having the recurring unit represented by the general formula (I), but it is preferred that the proportion of the component represented by the general formula (I) is from about 40 to 100 mol %, and preferably from 70 to 98 mol %.

Although there is no particular restriction on the molecular weight of the polymer used in the present invention, an average molecular weight of from about 10,000 to 1,000,000, and is preferably from about 50,000 to about 500,000 based on consideration of factors such the diffusion resistance properties with respect to the adjacent layers, handling properties, and so forth.

The polymers used in the present invention can be prepared with reference to the methods described in, for example, British Pat. No. 1,211,039, Japanese Patent Publication 29195/72, Japanese patent applications (OPI) 76593/73, 92022/73, 21134/74 and 120634/74, British Pat. No. 961,395, U.S. Pat. Nos. 3,227,672, 3,290,417, 3,262,919, 3,245,932, 2,681,897 and 3,230,275, John C. Petropoulos et al, *Official Digest* Vol. 33, Pages 719 to 736 (1961), Shunsuke Murahashi et al, *Gosei Kobunshi* (Synthetic Polymers), Vol. 1, pages 246 to 290 and Vol. 3, pages 1 to 108, etc. The kinds of polymerization initiators, the concentration, the polymerization temperature, the period of time employed for the reaction, etc., may, as a matter of course, be widely and easily changed according to the desired type of product.

For example, the polymerization can be carried out at from about 20° to 180° C., and preferably at from 40° to 120° C. The polymerization reaction is usually performed using a radical polymerization initiator in an amount of 0.05 to 5% by weight of the monomers to be polymerized. Examples of the initiator employed in the polymerization reaction are azobis compounds, peroxides, hydroperoxides, redox catalysts, etc., such as, for example, potassium persulfate, tert-butyl peroctoate, benzoyl peroxide, azobisisobutylonitrile, etc.

Specific examples of the polymers that can be used in the present invention are shown below, but are not to be limited thereto:

(1) Poly-N-vinyl pyrrolidone
(2) Poly-N-vinyl oxazolidone
(3) Poly-N-vinyl piperidone
(4) Poly-N-vinyl succinimide
(5) Poly-N-vinyl phthalimide
(6) Poly-N-vinyl-ε-caprolactam
(7) Copolymer of N-vinyl pyrrolidone and vinyl acetate (mole ratio of 70:30)
(8) Copolymer of N-vinyl pyrrolidone and vinyl acetate (mole ratio of 80:20)
(9) Copolymer of N-vinyl pyrrolidone and vinyl acetate (mole ratio of 90:10)
(10) Copolymer of N-vinyl pyrrolidone and vinyl acetate (mole ratio of 95:5)
(11) Copolymer of N-vinyl pyrrolidone and n-butyl methacrylate (mole ratio of 90:10)
(12) Copolymer of N-vinyl pyrrolidone and n-butyl methacrylate—(mole ratio of 95:5)
(13) Copolymer of N-vinyl pyrrolidone and n-butyl acrylate—(mole ratio of 80:20)
(14) Copolymer of N-vinyl pyrrolidone and methyl methacrylate—(mole ratio of 90:10)
(15) Copolymer of N-vinyl pyrrolidone and methyl acrylate—(mole ratio of 95:5)
(16) Copolymer of N-vinyl pyrrolidone and methoxyethyl acrylate—(mole ratio of 85:15)
(17) Copolymer of N-vinyl pyrrolidone and N-(1,1-dimethyl-3-oxobutyl)acrylamide—(mole ratio of 50:50)
(18) Copolymer of N-vinyl pyrrolidone and N-(tert-butyl)acrylamide—(mole ratio of 70:30)
(19) Copolymer of N-vinyl pyrrolidone, vinyl alcohol and vinyl acetate—(mole ratio of 80:15:5)
(20) Copolymer of N-vinyl pyrrolidone, N-vinyl succinimide and vinyl acetate—(mole ratio of 70:20:10)
(21) Copolymer of N-vinyl pyrrolidone, 2-ethoxyethyl acrylate—(mole ratio of 92:8)
(22) Copolymer of N-vinyl pyrrolidone, vinyl acetate and dimethylacrylamide—(mole ratio of 60:20:20)
(23) Copolymer of N-vinyl succinimide and vinyl acetate—(mole ratio of 75:25)
(24) Copolymer of N-vinyl succinimide and vinyl acetate—(mole ratio of 90:10)
(25) Copolymer of N-vinyl succinimide and n-butyl methacrylate—(mole ratio of 93:7)
(26) Copolymer of N-vinyl succinimide and N-(1,1-dimethyl-3-oxobutyl)acrylamide—(mole ratio of 65:35)
(27) Copolymer of N-vinyl succinimide and dimethylacrylamide—(mole ratio of 73:27)
(28) Copolymer of N-vinyl oxazolidone and vinylacetate—(mole ratio of 92:8)
(29) Copolymer of N-vinyl oxazolidone and n-butyl acrylate—(mole ratio of 95:5)
(30) Copolymer of N-vinyl oxazolidone and N-vinyl phthalimide—(mole ratio of 60:40)
(31) Copolymer of N-(2-methacryloyloxyethyl)pyrrolidone and N-(1,1-dimethyl-3-oxabutyl)acrylamide—(mole ratio of 70:30)
(32) Copolymer of N-(2-acrylamidoethyl)pyrrolidone and vinyl acetate—(mole ratio of 75:25)

Specific synthesis examples of the polymers used in the present invention are illustrated below.

SYNTHESIS EXAMPLE 1

Synthesis of Polymer (9)

A 5 liter 3-necked flask equipped with a stirrer, a reflux condenser, a nitrogen inlet conduit and a thermometer was placed on a steam bath. The air in the flask was purged with nitrogen gas. 1998 g of N-vinyl pyrrolidone newly purified by distillation, 172 g of vinyl acetate, 1700 g of ethyl acetate and 300 g of ethanol were put into the flask and the temperature in the flask was increased with stirring. Thereafter the temperature in the flask was constantly maintained at 60° C., while a half portion of a solution of 19.88 g of 2,2'-azobis(2,4-dimethylvaleronitrile) dissolved in a solvent mixture of 170 g of ethyl acetate and 30 g of ethanol (Solution A) was poured into the flask. A polymerization reaction began, with a gradual increase in temperature, and the reaction system was cooled by cold water so as not to exceed 65° C. After stirring for 3 hours at 60° C., the remainder of Solution A was added to the mixture. After further stirring for 2 hours at 60° C., the temperature was decreased to room temperature to finish the reaction. The intrinsic viscosity of the polymer obtained which was measured in a solvent mixture of ethyl acetate and ethanol (85:15 in weight ratio) at 30° C. was 0.55.

SYNTHESIS EXAMPLE 2

Synthesis of Polymer (12)

A 0.5 liter 3-necked flask equipped with a stirrer, a thermometer, a nitrogen inlet conduit and a reflux condenser was placed on a water bath. 105.45 g of N-vinyl pyrrolidone purified by distillation, 7.1 g of n-butyl methacrylate and 118.8 ml of a solvent mixture of ethyl acetate and ethanol (85:15 in weight ratio) were put into the flask. The air in the flask was purged with nitrogen gas and the temperature in the flask was increased to 60° C. A half portion of a solution of 0.994 g of 2,2'-azobis(2,4-dimethylvaleronitrile) dissolved in 50 ml of a solvent mixture of ethyl acetate and ethanol (85:15 in weight ratio) (Solution B) was poured into the flask. The mixture was stirred for 4 hours while maintaining the temperature at 60° C. The remainder of Solution B was added to the mixture and the mixture was further stirred for 2 hours at 60° C. 160 ml of a solvent mixture of ethyl acetate and ethanol (85:15 in weight ratio) was added to the mixture to dilute and the temperature was decreased to room temperature to finish the reaction. The intrinsic viscosity of the polymer obtained which was measured in a solvent mixture of ethyl acetate and ethanol (85:15 in weight ratio) at 30° C. was 0.40.

In the photographic light-sensitive material of the present invention, it is preferred to employ a dye releasing redox compound which is inherently diffusion resistant and releases a mobile (diffusible) dye upon development, which can be represented by the following formula (II):

$$Y—X \qquad (II)$$

wherein X represents a dye moiety or a dye precursor moiety which is connected directly or through a linking group $-(Z)-$ with Y; Z represents a linking group such as an alkylene group or alkylidene group having 1 to 6 carbon atoms, an arylene group or a heterocyclic group and the linking group, Z, is connected directly or through —O—, —S—, —$SO_2$—, —NRo— (wherein Ro represents a hydrogen atom or an alkyl group), —CO—, —CO—NH— or —$SO_2$—NH— with X; and Y represents a moiety which provides, as a result of development processing under alkaline conditions, a dye compound having a different diffusibility from that of the dye releasing redox compound represented by the general formula (II).

The above-described dye moiety can, in principle, be selected from any known kind of dye moiety. However, the dye moiety must have a sufficient diffusibility to reach to an image receiving layer through photographic layers of the light-sensitive material. For this purpose, one or more water solubility providing groups are bonded to the dye moiety. Suitable examples of the water solubility providing groups include a carboxy group, a sulfo group, a sulfonamide group, a sulfamoyl group and an aliphatic or aromatic hydroxy group. Where Y is a sulfamoyl group, a fairly large diffusibility in an alkaline medium can be provided to the dye molecule and the additionally existing water solubility providing group is not necessarily required. Examples of dyes particularly suitable for use in the present invention include an azo dye, an azomethine dye, an anthraquinone dye, a phthalocyanine dye, an indigoid dye, a triphenylmethane dye, a metal complex dye and a colored metal chelate.

The above described dye precursor moiety is a moiety of a compound capable of changing into a dye by isolation of auxochromatic group (auxochrome) in the coloring system (that is, the auxochrome which is isolated is joined in the chromophere) due to oxidation during conventional processing steps or additional processing steps in a photographic processing. In this case, the dye precursor may be a leuco dye or a dye which is converted into another dye during the photographic processing.

Examples of Y groups effective for the compound represented by the general formula (II) are N-substituted sulfamoyl groups. For example, there can be illustrated as Y the group represented by the following formula (A):

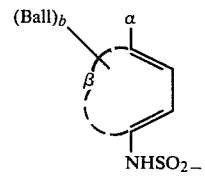

(A)

In the above formula, $\beta$ represents the non-metallic atoms necessary to complete a benzene ring, to which a carbon ring or a hetero ring may be fused to form, for example, a naphthalene ring, a quinoline ring, a 5,6,7,8-tetrahydronaphthalene ring, a chroman ring, etc. Further, said benzene ring or said ring wherein a carbocyclic ring or heterocyclic ring is condensed to the benzene ring may have a substituent or substituents such as a halogen atom, an alkyl group, an alkoxy group, an aryl group, an aryloxy group, a nitro group, an amino group, an alkylamino group, an arylamino group, an amido group, a cyano group, an alkylmercapto group, a keto group, a carboalkoxy group, a hetero ring group, etc.

$\alpha$ represents an —$OG^1$ or —$NHG^2$ group, wherein $G^1$ represents a hydrogen atom or a group capable of forming a hydroxyl group by hydrolysis, and preferably represents a hydrogen atom, $$-\overset{O}{\overset{\|}{C}}G^3 \text{ or } -\overset{O}{\overset{\|}{C}}-O-G^3$$

wherein $G^3$ represents an alkyl group, in particular, alkyl group having 1 to 18 carbon atoms (such as a methyl group, an ethyl group, a propyl group, etc.), a halogen-substituted alkyl group having 1 to 18 carbon atoms (such as a chloromethyl group, a trifluoromethyl group, etc.) a phenyl group or a substituted phenyl group, and $G^2$ represents a hydrogen atom, an alkyl group having 1 to 22 carbon atoms or a hydrolyzable group. Preferred examples of said hydrolyzable group represented by $G^2$ are $$-\overset{O}{\overset{\|}{C}}G^4, \quad -SO_2G^5 \text{ or } \quad -SOG^5,$$

wherein $G^4$ represents an alkyl group having 1 to 4 carbon atoms (such as a methyl group); a halogen-substituted alkyl group (such as mono-, di- or trichloromethyl group or a trifluoromethyl group); an alkylcarbonyl group (such as an acetyl group); an alkoxy group; a substituted phenyl group (such as a nitrophenyl group or a cyanophenyl group); a phenyloxy group unsubstituted or substituted by a lower alkyl group or a halogen atom; a carboxyl group; an alkyloxy carbonyl group; an aryloxycarbonyl group; an alkylsulfonyl ethoxy group; or an arylsulfonylethoxy group, and $G^5$ represents a substituted or unsubstituted alkyl or aryl group.

Further, b is an integer of 0, 1 or 2, wherein b represents 0 when said $\alpha$ represents $-NHG^2$ (wherein $G^2$ represents an alkyl group making the compound of the general formula (A) immobile and non-diffusible), and b represents 1 or 2, and preferably 1, when $\alpha$ represents a group represented by $-OG^1$ or $-NHG^2$ (wherein $G^2$ represents a hydrogen atom, an alkyl group having 1 to 8 carbon atoms or a hydrolyzable group). Ball represents a ballast group which will be described in detail hereinafter.

Specific examples of such Y groups are described in U.S. Pat. Nos. 4,152,153, 3,928,312 and 3,993,638, and Japanese Patent Application (OPI) 50736/78.

Other examples of Y groups are represented by the following formula (B):

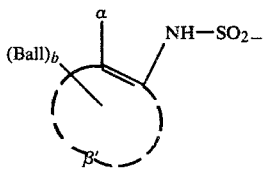

(B)

In the above formula, Ball, $\alpha$ and b are the same as defined in formula (A), $\beta'$ represents the atoms necessary to form a carbocyclic ring, for example, a benzene ring, to which a carbocyclic ring or a hetero ring may further be condensed to form a naphthalene ring, a quinoline ring, a 5,6,7,8-tetrahydronaphthalene ring, a chroman ring, etc. The above-described various rings may be further substituted by a halogen atom, an alkyl group, an alkoxy group, an aryl group, an aryloxy group, a nitro group, an amino group, an alkylamino group, an arylamino group, an amido group, a cyano group, an alkylmercapto group, a keto group, a carboalkoxy group, a hetero ring or the like. Specific examples of such Y groups are described in U.S. Pat. Nos. 4,053,312 and 4,055,428.

Further examples of Y groups that can be used include the group represented by general formula (C):

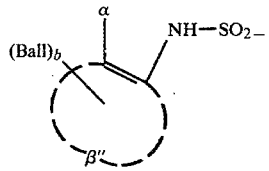

(C)

In the above formula, Ball, $\alpha$ and b are the same as defined in formula (A), and $\beta''$ represents atoms necessary to form a hetero ring such as a pyrazole ring, a pyridine ring, etc., to which a carbocyclic ring or a hetero ring may further be condensed. The above-described rings may be substituted by the same substituents as those for the rings described in formula (B). Specific examples of such Y groups are described in Japanese Patent Application (OPI) 104343/76.

Still further examples of Y groups that can be used are those represented by formula (D):

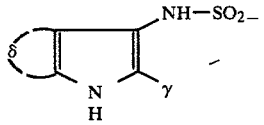

(D)

In the above formula, $\gamma$ preferably represents a hydrogen atom; an alkyl group, aryl group or hetero ring group which may be unsubstituted or substituted; or $-CO-G^6$ wherein $G^6$ represents $$-OG^7, \quad -S-G^7 \text{ or } \quad -N\begin{matrix} G^8 \\ G^9 \end{matrix}$$

(herein $G^7$ represents a hydrogen atom, an alkyl group, a cycloalkyl group or an aryl group, which may be substituted, $G^8$ represents the same group as $G^7$ or an acyl group derived from an aliphatic or aromatic carboxylic acid or sulfonic acid, and $G^9$ represents a hydrogen atom or a substituted or unsubstituted alkyl group), $\delta$ represents the atoms necessary for completing a condensed benzene ring, which ring may have one or more substituents, and $\gamma$ and/or the substituents on said condensed benzene ring completed by $\delta$ is a ballast group or a ballast-containing group. Specific examples of this type Y are described in Japanese patent application (OPI) Nos. 104343/76 and 46730/78.

A further example of Y groups that can be used are those represented by formula (E):

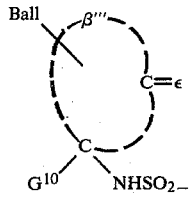

(E)

In the above formula, Ball is the same as defined in formula (A), $\epsilon$ represents an oxygen atom or =NG'' (G'' represents a hydroxy group or an amino group which may be substituted) and, when $\epsilon$ represents =NG'', a typical example of G'' is that in =C=N-G'' formed by the dehydration reaction between a carbonyl reagent of $H_2N$—G'' and a ketone group. Examples of the compound of $H_2N$—G'' are hydroxylamines, hydrazines, semicarbazides, thiosemicarbazides, etc. To be specific, there are illustrated, as the hydrazines, hydrazine, phenylhydrazine, substituted phenylhydrazine having in the phenyl moiety a substituent or substituents such as an alkyl group, an alkoxy group, a carboalkoxy group, a halogen atom, etc., isonicotinic acid hydrazine, etc. As the semicarbazides, there are illustrated, phenylsemicarbazide or substituted phenylsemicarbazide substituted by an alkyl group, an alkoxy group, a carboalkoxy group, a halogen atom, etc. As the semithiocarbazides, there are illustrated the same derivatives as with semicarbazides.

$\beta'''$ in the formula represents the carbon atoms necessary to complete a 5-, 6- or 7-membered saturated or unsaturated non-aromatic carbocyclic rings. To be specific, there are illustrated, for example, cyclopentanone, cyclohexanone, cyclohexenone, cyclopentenone, cycloheptanone, cycloheptenone, etc.

These 5- to 7-membered non-aromatic carbocyclic rings may be condensed to other rings to form a condensed ring system. As the other ring, various rings may be used regardless of whether they show aromaticity or not or whether they are carbocyclic rings or hetero rings. However, in the case of a condensed ring being formed, condensed systems wherein benzene and the above-described 5- to 7-membered non-aromatic carbocyclic ring are condensed to each other such as indanone, benzcyclohexenone, benzcycloheptenone, etc., are preferable in the present invention.

The above-described 5- to 7-membered non-aromatic carbocyclic rings or the above-described condensed rings may have one or more substituents such as an alkyl group, an aryl group, an alkyloxy group, an aryloxy group, an alkylcarbonyl group, an arylcarbonyl group, an alkylsulfonyl group, an arylsulfonyl group, a halogen atom, a nitro group, an amino group, an alkylamino group, an arylamino group, an amido group, an alkylamido group, an arylamido group, a cyano group, an alkylmercapto group, an alkyloxycarbonyl group, etc.

$G^{10}$ represents a hydrogen atom, or a halogen atom such as fluorine, chlorine or bromine.

Specific examples of this type Y are described in Japanese Patent Application (OPI) No. 3819/78.

As the still further examples of Y groups, there are those described in, for example, U.S. Pat. Nos. 3,443,943, 3,751,406, 3,443,939, 3,443,940, 3,628,952 and 3,844,785.

As the different type compounds represented by the general formula (II), there are illustrated dye-releasing redox compounds which release a diffusible dye under alkaline condition through self cyclization or the like but, when reacted with the oxidation product of developing agent, which do not substantially release the dye.

Other examples of Y groups are those represented by formula (F):

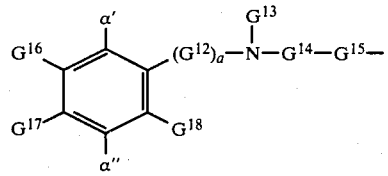

(F)

In the above formula, $\alpha'$ represents an oxidizable nucleophilic group such as a hydroxyl grouu, a primary or secondary amino group, a hydroxyamino group or a sulfonamido group, or the precursor thereof, and preferably represents a hydroxyl group.

$\alpha''$ represents a dialkylamino group or any of those defined for $\alpha'$, preferably a hydroxyl group. $G^{14}$ represents an electrophilic group such as —CO—, —CS—, etc., preferably —CO—. $G^{15}$ represents an oxygen atom, a sulfur atom, a selenium atom, a nitrogen atom, etc., and, when $G^{15}$ represents a nitrogen atom, it may be substituted by a hydrogen atom, an unsubstituted or substituted alkyl group having 1 to 10 carbon atoms, or an aromatic compound residue having 6 to 20 carbon atoms. Preferable $G^{15}$ is an oxygen atom. $G^{12}$ represent an alkylene group containing 1 to 3 carbon atoms, and a represents 0 or 1, preferably 0. $G^{13}$ is a substituted or unsubstituted alkyl group containing 1 to 40 carbon atoms or a substituted or unsubstituted aryl group containing 6 to 40 carbon atoms, preferably an alkyl group. $G^{16}$, $G^{17}$ and $G^{18}$ each represents a hydrogen atom, a halogen atom, a carbonyl group, a sulfamyl group, a sulfonamido group, an alkyloxy group containing 1 to 40 carbon atoms, or the same as defined for $G^{13}$ or, when taken together, $G^{16}$ and $G^{17}$ a 5- to 7-membered ring. Also, $G^{17}$ may be

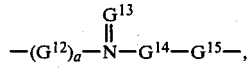

provided that at least one of $G^{13}$, $G^{16}$, $G^{17}$ and $G^{18}$ represents a ballast group.

Specific examples of such Y groups are described in U.S. Pat. No. 3,980,479.

Another example of Y groups are those represented by the formula (G):

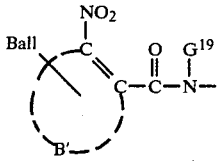

(G)

wherein Ball and $\beta'$ are the same as defined in formula (B), and $G^{19}$ represents an alkyl group (including substituted alkyl group). Specific examples of this type Y are described in Japanese Patent Application (OPI) No. 33553/78.

The examples of Y groups are further illustrated by the groups represented by the formula (H):

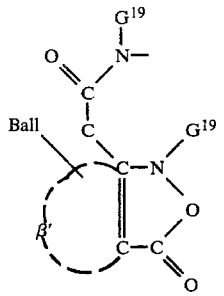

(H)

wherein Ball and $\beta'$ are the same as defined in formula (B), and $G^{19}$ is the same as defined in formula (G). Specific examples of this type Y are described in Japanese patent application (OPI) Nos. 111628/74 and 4819/77.

The ballast group, Ball, is an organic ballast group capable of rendering the dye-releasing redox compound non-diffusible during development in an alkaline processing solution and preferably is or contains a hydrophobic residue having 8 to 32 carbon atoms. This organic ballast group can be bonded to the dye-releasing redox compound directly or through a linking group, for example, an imino bond, an ether bond, a thioether bond, a carbonamido bond, a sulfonamido bond, a ureido bond, an ester bond, an imido bond, a carbamoyl bond, a sulfamoyl bond, etc.

Specific examples of ballast groups are illustrated below.

An alkyl group or an alkenyl group (for example, a dodecyl group, an octadecyl group, etc.), an alkoxyalkyl group (for example, a 3-(octyloxy)propyl group, a 3-(2-ethylundecyloxy)propyl group, etc., as described in Japanese patent publication No. 27563/64, etc.), an alkylaryl group (for example, a 4-nonylphenyl group, a 2,4-di-tert-butylphenyl group, etc.), an alkylaryloxyalkyl group (for example, a 2,4-di-tert-pentylphenoxymethyl group, an α-(2,4-di-tert-phenylphenoxy)propyl group, a 1-(3-pentadecylphenoxy)ethyl group, etc.), an acylamidoalkyl group (for example, a group described in U.S. Pat. No. 3,337,344 and 3,418,129, a 2-(N-butylhexadecanamido)ethyl group, etc.), an alkoxyaryl or aryloxyaryl group (for example, a 4-(n-octadecyloxy)phenyl group, a 4-(4-n-dodecylphenyloxy)phenyl group, etc.), a residue containing both an alkyl or alkenyl long-chain aliphatic group and a water-solubilizing group such as a carboxy group or a sulfo group (for example, a 1-carboxymethyl-2-nonadecenyl group, a 1-sulfoheptadecyl group, etc.), an alkyl group substituted with an ester group (for example, a 1-ethoxycarbonylheptadecyl group, a 2-(n-dodecyloxycarbonyl-)ethyl group, etc.), an alkyl group substituted with an aryl group or a heterocyclic group (for example, a 2-[4-(3-methoxycarbonyluneicosanamido)phenyl]ethyl group, a 2-[4-(2-n-octadecylsuccinimido)phenyl]ethyl group, etc.), and an aryl group substituted with an aryloxyalkoxycarbonyl group (for example, a 4-[2-(2,4-di-tert-pentylphenoxy)-2-methylpropyloxycarbonyl]phenyl group).

Of the above-described organic ballast groups, those bonded to a bridging group as represented by the following general formulae (III) to (VII) are particularly preferred.

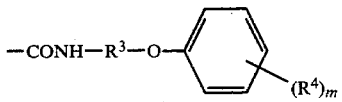

(III)

$-CONH-R^3-O-$ $(R^4)_m$ $-CONH-R^3-O-R^4$ (IV)

$-O-R^5$ (V)

$-CONHR^4$ (VI)

$-CONR^4R^6$ (VII)

wherein $R^3$ represents an alkylene group having 1 to 10 carbon atoms, preferably 1 to 6 carbon atoms (such as a propylene group, a butylene group, etc.); $R^4$ represents a hydrogen atom or an alkyl group having 1 to 10 carbon atoms, preferably 1 to 6 carbon atoms (such as a tert-amyl group, etc.); m represents an integer of 1 to 5 (preferably 1 to 2); $R^4$ represents an alkyl group having 4 to 30 carbon atoms, preferably 10 to 20 carbon atoms (such as a dodecyl group, a tetradecyl group, a hexadecyl group, etc.); $R^5$ represents an alkyl group having 8 to 30 carbon atoms, preferably 10 to 20 carbon atoms (such as a hexadecyl group, an octadecyl group, etc.) or a substituted alkyl group having 8 or more carbon atoms in which the alkyl moiety has one or more carbon atoms, with examples of suitable substituents being one or more of, for example, a carbamoyl group, etc.; and $R^6$ has the same meaning as defined in $R^4$.

Of the above described compounds, particularly effective groups Y are N-substituted sulfamoyl groups. As the N-substituents for the N-substituted sulfamoyl groups, carbocyclic ring groups or hetero ring groups are desirable. As the examples of N-carbocyclic ring substituted sulfamoyl groups, those represented by formulae (A) and (B) are particularly preferable. As the examples of N-hetero ring substituted sulfamoyl groups, those represented by formulae (C) and (D) are particularly preferable.

Examples of the dye releasing redox compounds are described, for example, in Japanese patent application (OPI) Nos. 33826/73, 126331/74, 104343/76, 46730/78, 113624/76 and 47823/78, *Research Disclosure,* Vol. 151, No. 15157 (November, 1976), ibid., Vol. 130, No. 13024 (February, 1975), ibid., Vol. 156, No. 15654 (April, 1977), etc.

Specific examples of the dye releasing redox compounds include the compounds described in Examples hereinafter as well as the following compounds:

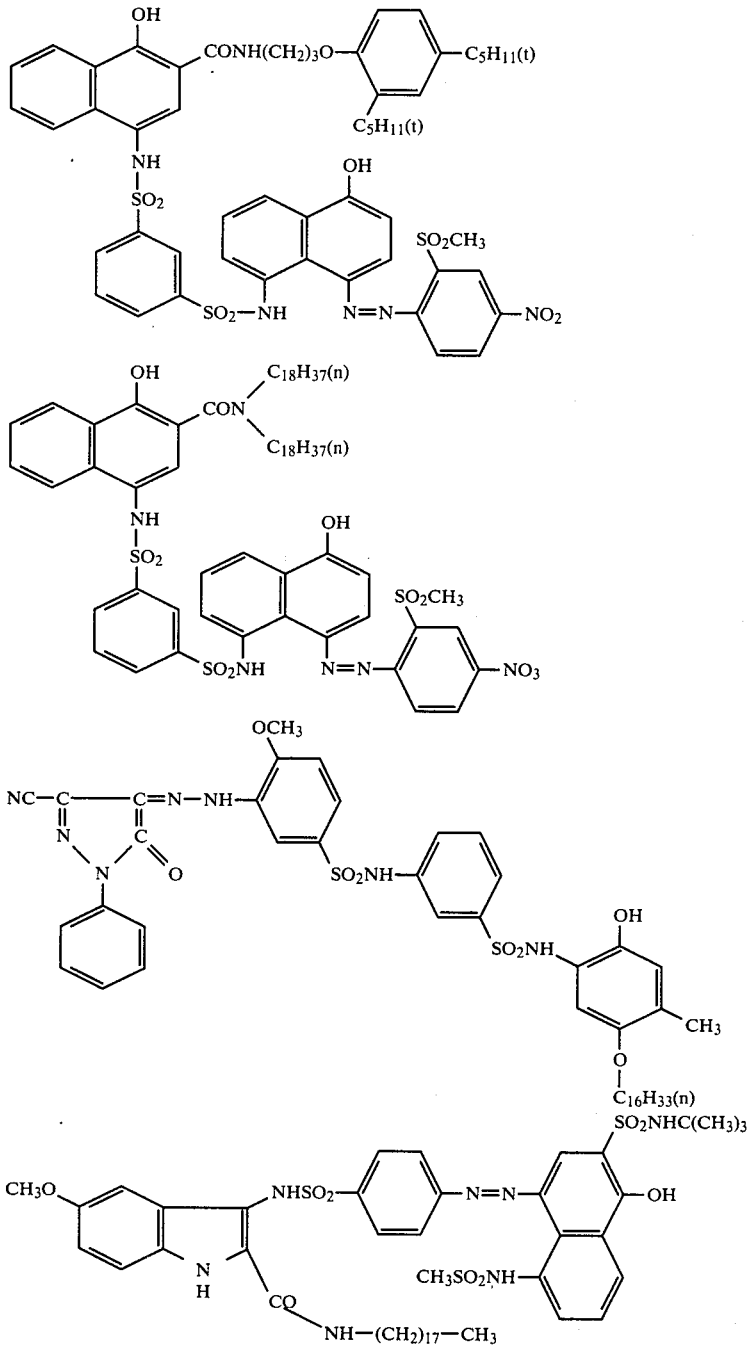

The dye releasing redox compound can be present either in a silver halide emulsion layer or in a separate layer, distinct from the interlayer used to separate emulsion layers, which is adjacent to a silver halide emulsion layer.

A coating amount of the dye releasing redox compound ranges suitably from $1\times10^{-4}$ to $1\times10^{-2}$ mol/m$^2$ and preferably from $2\times10^{-4}$ to $2\times10^{-3}$ mol/m$^2$.

Further, the photographic light-sensitive material of the present invention can contain, as a dye-image forming material, a dye image forming coupler, that is, a compound capable of forming a dye upon the reaction of the oxidation product of an aromatic amine (conventionally primary amine) developing agent therewith (hereinafter referred to as a coupler).

Non-diffusible couplers which contain a hydrophobic group, called a ballast group, in the molecule thereof are preferred as couplers. Couplers can be 4-equivalent or 2-equivalent couplers. In addition, colored couplers providing a color correction effect or couplers which release development inhibitors upon development (the so-called DIR couplers) can also be present therein. Also, couplers which provide a colorless product on coupling can be employed.

Conventional open chain ketomethylene type couplers can be employed as yellow color forming couplers. Of these couplers, benzoyl acetanilide type and pivaloyl acetanilide type compounds are especially effective. Specific examples of yellow color forming couplers which can be employed are described, for example, in U.S. Pat. Nos. 2,875,057, 3,265,506, 3,408,194, 3,551,155, 3,582,322, 3,725,072 and 3,891,445, German Pat. No. 1,547,868, German patent application (OLS) Nos. 2,219,917, 2,261,361 and 2,414,006, British Pat. No. 1,425,020, Japanese patent publication No. 10783/76, Japanese patent application (OPI) Nos. 26133/72, 73147/73, 102636/76, 6341/75, 123342/75, 130442/75, 21827/76, 87650/75, 82424/77 and 115219/77, etc.

Pyrazolone type compounds, indazolone type compounds cyanoacetyl compounds, etc., can be employed as magenta color forming couplers and particularly preferred couplers are pyrazolone type compounds. Specific examples of magenta color forming couplers which can be employed are those described, for example, in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445, German Pat. No. 1,810,464, German patent application (OLS) Nos. 2,408,665, 2,417,945, 2,418,959 and 2,424,467, Japanese patent publication Nos. 6031/65 and 45990/76, Japanese patent application (OPI) Nos. 20826/76, 58922/77, 129538/74, 74027/74, 159336/75, 42121/77, 74028/74, 60233/75, 26541/76, and 55122/78, etc.

Phenol type compounds, naphthol type compounds, etc., can be employed as cyan color forming couplers. Specific examples of cyan color forming couplers which can be employed are those described, for example, in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411 and 4,004,929, German patent application (OLS) Nos. 2,414,830 and 2,454,329, Japanese patent application (OPI) Nos. 59838/73, 26034/76, 5055/73, 146828/76, 69624/77 and 90932/77, etc.

Colored couplers which can be employed are those described, for example, in U.S. Pat. Nos. 3,476,560, 2,521,908 and 3,034,892, Japanese patent publication Nos. 2016/69, 22335/63, 11304/67 and 32461/69, Japanese patent application (OPI) Nos. 26034/76 and 42121/77, German patent application (OLS) 2,418,959, etc.

DIR couplers which can be employed are those described, for example, in U.S. Pat. Nos. 3,227,554, 3,617,291, 3,701,783, 3,790,384 and 3,632,345, German patent application (OLS) Nos. 2,414,006, 2,454,301 and 2,454,329, British Pat. No. 953,454, Japanese patent application (OPI) Nos. 69624/77, 122335/74 and 69624/77, Japanese patent publication No. 16141/76, etc.

In addition to DIR couplers, compounds which release development inhibitors upon development can also be present in the light-sensitive material. For example, those DIR compounds as described, for example, in U.S. Pat. Nos. 3,297,445 and 3,379,529, German patent application (OLS) No. 2,417,914, Japanese patent application (OPI) Nos. 15271/77 and 9116/78, etc. can be employed.

Two or more kinds of the couplers described above can be incorporated in the same layer or the same coupler compound can also be present in two or more layers.

These couplers are incorporated into the emulsion layers, generally in an amount of about $2\times10^{-3}$ mol to about $5\times10^{-1}$ mol, preferably $1\times10^{-2}$ mol to $5\times10^{-1}$ mol, per mol of silver.

The dye image forming materials which can be used in the present invention can be dispersed in a carrier (a hydrophilic colloid), according to various methods, depending upon the type of compound. For example, compounds having a dissociative group such as a sulfo group or a carboxy group can be added to a hydrophilic colloid solution after being dissolved in water or in an alkaline aqueous solution. With dye image forming materials which are slightly soluble in an aqueous medium and readily soluble in an organic solvent, they are first dissolved in an organic solvent, and then the resulting solution added to a hydrophilic colloid solution, followed by stirring or the like to disperse the same as fine particles. As suitable solvents, there are ethyl acetate, butyl acetate, ethyl propionate, secondary butyl alcohol, methyl isobutyl ketone, β-ethoxyethyl acetate, methyl Cellosolve acetate, tetrahydrofuran, methyl ethyl ketone, cyclohexanone, β-butoxy-β-ethoxyethyl acetate, dimethylformamide, dimethylsulfoxide, 2-methoxyethanol, tri-n-butyl phthalate, etc. Of these dispersion solvents, those which possess a comparatively low vapor pressure can be vaporized upon drying of the photographic layers, or can be vaporized according to the method described in U.S. Pat. Nos. 2,322,027 and 2,801,171 prior to coating. Of these dispersion solvents, those which are readily soluble in water can be removed by washing with water according to the method described in U.S. Pat. Nos. 2,949,360 and 3,396,027.

In order to stabilize the dispersion of the dye image forming material and to accelerate the dye image forming step, it is advantageous to dissolve the dye image forming material in a solvent which is substantially insoluble in water and has a boiling point of not less than 200° C. under atmospheric pressure. As high boiling point solvents suitable for this purpose, there are fatty acid esters such as triglycerides of higher fatty acids, dibutoxyethyl succinate, dioctyl azelate and octyl adipate; phthalic acid esters such as di-n-butyl phthalate and dioctyl phthalate; phosphoric acid esters such as diphenyl phosphate, triphenyl phosphate, dioctyl butyl phosphate, tri-o-cresyl phosphate and tri-n-hexyl phosphate; amides such as N,N-diethyllaurylamide; hydroxy compounds such as 2,4-di-n-amulphenol; citric acid esters such as acetyl tributyl citrate; benzoic acid esters such as octyl benzoate; and those described in U.S. Pat. Nos. 2,322,027, 2,533,514 and 2,835,579, Japanese patent publication No. 23233/71, U.S. Pat. No. 3,287,134, British Pat. No. 958,441, Japanese patent application (OPI) No. 1031/72, British Pat. No. 1,222,753, U.S. Pat. No. 3,936,303, Japanese patent application (OPI) Nos. 26037/76 and 82078/75, U.S. Pat. Nos. 2,353,262, 2,852,383, 3,554,755, 3,676,137, 3,676,142, 3,700,454, 3,748,141 and 3,837,863, German patent application (OLS) No. 2,538,889, Japanese patent application (OPI) Nos. 27921/76, 27922/76, 26035/76, 26036/76 and 62632/75, Japanese patent publication No. 29461/74, U.S. Pat. Nos. 3,936,303 and 256,658, Japanese patent application (OPI) No. 1521/78, etc.

Furthermore, in order to stabilize the dispersion of the dye image forming material and to accelerate the step of dye image formation, it is advantageous to incorporate a polymer having affinity for the solvent together with the dye image forming material into the light-sensitive material. As polymers having such affinity for the solvent and suitable for this purpose, there are shellac, phenolformaldehyde condensates, poly-n-butyl acrylates, n-butyl acrylate-acrylic acid copolymers, n-butyl acrylate-styrenemethacrylamide copolymers, and the like. These polymers may be dissolved in an organic solvent together with the dye image forming material, and then dispersed in a hydrophilic colloid, or may be added, as a hydrosol prepared by emulsion polymerization or the like, to a hydrophilic colloid dispersion of the dye image forming material.

In general, the dispersion of the dye image forming material can effectively be conducted under a high shearing force. For example, a high speed rotary mixer, a colloid mill, a high pressure milk homogenizer, a high pressure homogenizer as described in British Pat. No. 1,304,264, an ultrasonic emulsifying apparatus, and the like are useful. The use of a surface active agent as an emulsifying aid markedly serves to disperse the dye image forming material. As the surface active agents useful for the dispersion of the dye image forming material used in the present invention, there are sodium triisopropylnaphthalenesulfonate, sodium dinonylnaphthalenesulfonate, sodium p-dodecylbenzenesulfonate, dioctyl sulfosuccinate sodium salt, sodium cetylsulfate, and the anionic surface active agents as described in Japanese Patent Publication No. 4293/64. The combined use of these anionic surface active agents and higher fatty acid esters of anhydrohexitol shows a particularly good emulsifying ability as described in U.S. Pat. No. 3,676,141.

A coating amount of the mixture of hydroquinone derivatives ranges suitably from about $2\times10^{-4}$ to $1\times10^{-2}$ mol/m$^2$, and preferably from about $1\times10^{-3}$ to $7\times10^{-3}$ mol/m$^2$.

A molar ratio of polymer used according to the invention (in moles of recurring unit)/mixture of hydroquinone derivatives (in moles) ranges suitably from about 0.05/1 to 5/1, and preferably from about 0.2/1 to 2/1, based on the calculation using the recurring unit represented by formula (I) as representing the entire molecular weight of the polymer.

In order to provide an interlayer using the mixture of hydroquinone derivatives and the polymer used in the present invention, it is possible, for example to: (1) dissolve both components in a water insoluble, low boiling point solvent such as ethyl acetate or methyl ethyl ketone, (2) disperse the solution in an aqueous gelatin solution, and (3) coat the resulting dispersion on a photographic layer and to dry it. When both components are dissolved in the low boiling point solvent, a water soluble, low boiling point solvent such as methanol can be together therewith, in a part, for example, of from 10 to 14% by weight. Also, in the dispersion step, the use of surface active agents which are employed for the dispersion of the dye image forming material is effective.

One example of the formation of color diffusion transfer images using a dye releasing redox compound is that containing the following steps:

(A) A photographic light-sensitive material comprising a support having thereon at least two light-sensitive silver halide emulsion layers with a dye releasing redox compound associated therewith is imagewise exposed.

(B) An alkaline processing composition is spread on the above-described light-sensitive silver halide emulsion layer whereby development of all light-sensitive silver halide emulsion layers in the presence of a developing agent for silver halide is conducted.

(C) As a result, an oxidation product of the developing agent produced in proportion to the amount of exposure cross-oxidizes the dye releasing redox compound.

(D) The above-described oxidation product of the dye releasing redox compound splits to release a diffusible dye.

(E) The dye is released imagewise, and diffuses to form a transferred image on an image-receiving layer (directly or indirectly) adjacent the light-sensitive silver halide emulsion layer.

In the above-described process, any silver halide developing agents which can cross-oxidize the dye releasing redox compound can be used. These developing agents may be incorporated into the alkaline processing composition or may be incorporated into appropriate photographic layers of the light-sensitive element. Specific examples of suitable developing agents which can be used in this invention are, for example, hydroquinones such as hydroquinone, methylhydroquinone, chlorohydroquinone, bromohydroquinone, etc.; aminophenols such as N-methylaminophenol; pyrazolidones such as phenidone (1-phenyl-3-pyrazolidone), dimezone (1-phenyl-4,4-dimethyl-3-pyrazolidone), 1-phenyl-4-methyl-4-oxymethyl-3-pyrazolidone; phenylenediamines such as N,N-diethyl-p-phenylenediamine, 3-methyl-N,N-diethyl-p-phenylenediamine, 3-methoxy-N-ethoxy-p-phenylenediamine: etc.

Of the above-indicated developing agents, black-and-white developing agents having the capability, in general, of reducing the occurrence of stains in image-receiving layers are particularly preferred in comparison, with color developing agents such as phenylenediamines, in order to obtain dye images by a color diffusion transfer process.

The alkaline processing composition may contain a compound which accelerates development or accelerates diffusion of dyes. Example of such a compound is benzyl alcohol.

An image-receiving layer, a neutralizing layer, a neutralization rate controlling layer (timing layer) and a processing composition which can be used in the light-sensitive material of the present invention are described in, for example, Japanese patent application No. 64533/77.

The photographic light-sensitive material of the present invention is preferably a photographic film unit, that is a film unit which has a construction such that after imagewise exposure, the processing of the film unit is performed by passing the film unit through a pair of juxtaposed pressure-applying members.

An embodiment of the superimposed and integral type film unit to which the present invention is most preferably applicable is disclosed in Belgian Pat. No. 757,959. According to this embodiment, the film unit is prepared by coating on a transparent support, an image-receiving layer, a substantially opaque light reflective layer (for example, a $TiO_2$-containing layer and a carbon black-containing layer), and a single or plurality of light-sensitive layers as described above, in this order, and further superimposed a transparent cover sheet on the light-sensitive layer in a face-to-face relationship. A rupturable container retaining an alkaline processing composition having incorporated therein an opacifying agent such as, for example, carbon black, is disposed adjacent to and between the uppermost layer (protective layer) of the above-described light-sensitive element and the transparent cover sheet. The film unit is imagewise exposed in a camera through the transparent cover sheet and then the rupturable container retaining the alkaline processing composition is ruptured by the pressure-applying members when the film unit is withdrawn from the camera to spread uniformly the processing composition containing the opacifying agent between the light-sensitive layer and the cover sheet, whereby the film unit is shielded from light in a sandwich form and development proceeds in a light place.

In these embodiments of film units, the neutralization mechanism as described above is preferably incorporated therein. In particular, the neutralizing layer is preferably positioned in the cover sheet and, further, the timing layer is positioned on the side toward where the processing solution is to be spread, if desired.

Moreover, other useful embodiments of the integral type of film units wherein the photographic light-sensitive material having the layer structure according to the present invention can be used are described in, for example, U.S. Pat. Nos. 3,415,644, 3,415,645, 3,415,646, 3,647,487, and 3,635,707 and German patent application (OLS) No. 2,426,980.

The above described effects which can be achieved with the present invention result from the formation of a complex composed of liquid hydroquinone derivatives and the polymer used in the present invention through hydrogen bonds, as a result to immobilize the liquid mixture of hydroquinone derivatives. The complex of liquid hydroquinones derivatives and the polymer is easily obtained as a solid product, for example, by dissolving 0.5 g of a copolymer of N-vinyl pyrrolidone and vinyl acetate (mole ratio of 90:10) which is the polymer used in the present invention per 1 g of an isomeric mixture of 2,5-di-tert-pentadecyl hydroquinones in a water-insoluble, low boiling point solvent such as ethyl acetate, etc. and removing the solvent. Further, for comparison, the same procedure described above was carried out using an isomer mixture of 2,5-di-tert-pentadecyl quinones which is considered incapable of forming a complex with the polymer used in the present invention, the solidification phenomenon described above was not observed at all as expected.

The present invention is explained in greater detail with reference to the following examples.

EXAMPLE 1

On a polyethylene terephthalate support were coated a white reflective layer containing 44 g/m$^2$ of titanium dioxide and 4.4 g/m$^2$ of gelatin and each of coating compositions No. 1 and No. 2 prepared by the method described below in this order and dried.

These Samples No. 1 and No. 2 were stored under normal condition for 7 days (Condition A) or under accelerated condition at 60° C. and 80% RH for 3 days (Condition B) and surface state and coloration degree of the samples were observed.

Emulsification of Coating Composition No. 1

40 g of an isomer mixtures of 2,5-di-tert-pentadecyl hydroquinones was dissolved in 20 cc of ethyl acetate. The solution was dispersed in 600 g of a 10% aqueous gelatin solution using sodium dodecylbenzenesulfonate as a dispersing aid.

Emulsification of Coating Composition No. 2

40 g of an isomer mixture of 2,5-di-tert-pentadecyl hydroquinones and 8 g of a copolymer of N-vinyl pyrrolidone and vinyl acetate (mole ratio of 7:3) was dissolved in 20 cc of ethyl acetate. The solution was dispersed in 600 g of a 10% aqueous gelatin solution using sodium dodecylbenzenesulfonate.

| | |
|---|---|
| Composition of Coating Composition No. 1 | |
| Gelatin | 1.5 g/m$^2$ |
| Isomer mixture of 2,5-di-tert-pentadecyl hydroquinones | 1.0 g/m$^2$ |
| Composition of Coating Composition No. 2 | |
| Gelatin | 1.5 g/m$^2$ |
| Isomer mixture of 2,5-di-tert-pentadecyl hydroquinone | 1.0 g/m$^2$ |
| Copolymer of N-vinyl pyrrolidone and vinyl acetate (mole ratio of 7:3) | 0.20 g/m$^2$ |

TABLE 1

| | Coloration Degree (yellow reflective density) | | |
|---|---|---|---|
| Sample | Condition A | Condition B | Reference |
| No. 1 | 0.19 | 0.33 | Comparison |
| No. 2 | 0.18 | 0.20 | Invention |

From the result shown in Table 1 it is apparent that Sample No. 2 is hardly colored under Condition B while Sample No. 1 is strongly colored. The coloration is considered due to oxidation of the hydroquinone derivatives. Further, in Sample No. 1 the coated surface is oily even under Condition A and in extremely oily under Condition B due to the accelerated mobilization of the hydroquinone derivatives to the surface. On the other hand, with Sample No. 2 the surface is not oily under both Conditions A and B.

EXAMPLE 2

A Light-Sensitive Material (I) according to the present invention and a Comparative Light-Sensitive Material (II) each having the construction and composition described below were prepared. After one week, each light-sensitive material was subjected to store under a condition of 45° C. and 70% RH for 3 days or in a room (at 25° C. and 50% RH) for 3 days. Then each light-sensitive material was exposed through an optical step wedge having a density deference of 0.2 per step using a tungsten lamp of a color temperature of 2854° K. (the maximum exposure amount of 10 CMS). The exposed light-sensitive material was processed by passing through a pair of juxtaposed pressure-applying rollers.

The Light-Sensitive Material (I) according to the present invention was a sheet type light-sensitive material in which a Light-Sensitive Element (I) comprising a transparent polyethylene terephthalate support having thereon the layers described below in the order listed and a cover sheet described below were fixedly superimposed in a face-to-face relationship and a pressure-rupturable pouch-like container (containing a various processing solution having the composition described below) was so assembled between the light-sensitive element and the cover sheet and on the edge of these elements that the alkaline viscous processing solution would be spread between the light-sensitive element and the cover sheet.

The cover sheet was prepared by coating on a transparent polyethylene terephthalate support the following layers in the order listed:

(1) A neutralizing layer composed of 10 g/m$^2$ of polyacrylic acid (2) A timing layer composed of 10 g/m$^2$ of acetyl cellulose

| Composition of Viscous Processing Solution | |
|---|---|
| Water | 820 cc |
| 1 N Sulfuric Acid | 5 cc |
| Hydroxyethyl Cellulose | 60 g |
| 4-Hydroxymethyl-4-methyl-1-phenyl-3-pyrazolidone | 5 g |
| 5-Methylbenzotriazole | 2 g |
| tert-Butylhydroquinone | 0.4 g |
| Sodium Sulfite | 2 g |
| Carbon Black | 150 g |
| Sodium Hydroxide | 30 g |

Construction and Composition of Light-Sensitive Element (1) An image-receiving layer containing 4.0 g/m$^2$ of copoly[styrene-N-vinylbenzyl-N,N,N-trihexyl ammonium chloride] and 4.0 g/m$^2$ of gelatin.

(2) A white reflecting layer containing 22 g/m$^2$ of titanium dioxide and 2.2 g/m$^2$ of gelatin.

(3) An opaque layer containing 2.7 g/m$^2$ of carbon black and 2.7 g/m$^2$ of gelatin.

(4) A layer containing 0.50 g/m$^2$ of a cyan dye-releasing redox compound described below, 0.50 g/m$^2$ of N,N-diethyllaurylamide and 1.5 g/m$^2$ of gelatin.

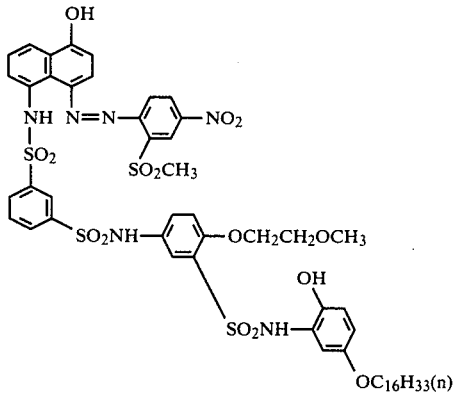

(5) A layer containing a red-sensitive internal latent image type emulsion (containing 1.1 g/m$^2$ of gelatin and 1.4 g/m$^2$ of silver), 0.015 g/m$^2$ of 1-acetyl-2-[4-(2,4-di-tert-pentylphenoxyacetamido)phenyl]-hydrazine and 0.067 g/m$^2$ of sodium 2-pentadecyl hydroquinone-5-sulfonate.

(6) A color mixing preventing agent containing layer containing 1.0 g/m$^2$ of gelatin, 1.0 g/m$^2$ of an isomer mixture of 2,5-di-tert-pentadecyl hydroquinones and 0.25 g/m$^2$ of a copolymer of N-vinyl pyrrolidone and vinyl acetate (mole ratio of 7:3).

(7) A layer containing 0.80 g/m$^2$ of a magenta dye-releasing redox compound described below, 0.20 g/m$^2$ of N,N-diethyllaurylamide and 1.2 g/m$^2$ of gelatin.

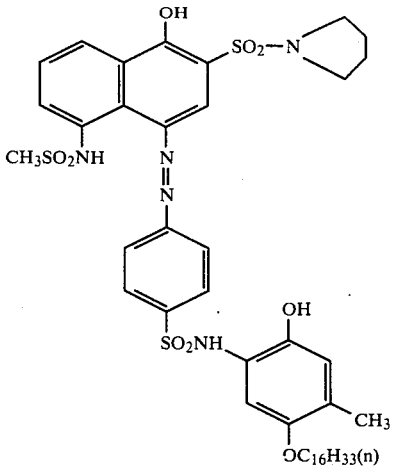

(8) A layer containing a green-sensitive internal latent image type silver iodobromide emulsion (containing 1.1 g/m$^2$ of gelatin and 1.4 g/m$^2$ of silver), 0.015 g/m$^2$ of 1-acetyl-2-[4-(2,4-di-tert-pentylphenoxyacetamido)-phenyl]hydrazine and 0.067 g/m$^2$ of sodium 2-pentadecyl hydroquinone-5-sulfonate.

(9) A color mixing preventing agent containing layer containing 1.0 g/m$^2$ of gelatin, 1.0 g/m$^2$ of an isomer mixture of 2,5-di-tert-pentacedyl hydroquinones and 0.25 g/m$^2$ of a copolymer of N-vinyl pyrrolidone and vinyl acetate (mole ratio of 7:3).

(10) A layer containing 1.0 g/m$^2$ of a yellow dye-releasing redox compound described below, 0.25 g/m$^2$ of N,N-diethyllaurylamide and 1.0 g/m$^2$ of gelatin.

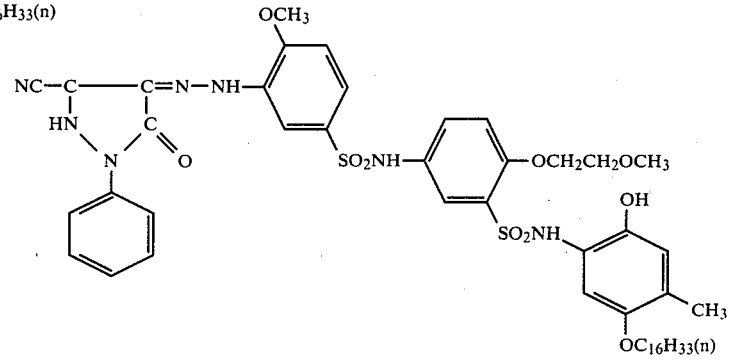

(11) A layer containing a blue-sensitive internal latent image type silver iodobromide emulsion (containing 1.1 g/m$^2$ of gelatin and 1.4 g/m$^2$ of silver), 0.015 g/m$^2$ of 1-acetyl-2-[4-(2,4-di-tert-pentylphenoxyacetamido)-phenyl]hydrazine and 0.067 g/m$^2$ of sodium 2-pentadecyl hydroquinone-5-sulfonate.

(12) A protective layer containing 1.3 g/m$^2$ of gelatin, 0.9 g/m$^2$ of a latex of polyethylene acryl acrylate, 0.5 g/m$^2$ of Tinubin and 0.026 g/m$^2$ of trisacryloyl perhydrotriazine as a hardener.

As a comparative sample to the Light-Sensitive Material (I) according to the present invention, a Comparative Light-Sensitive Material (II) was prepared in the same manner as described in Light-Sensitive Material (I) except substituting Layers (6)′ and (9)′ described for Layers (6) and (9) of Light-Sensitive Material (I), respectively.

Layer (6)′: A color mixing preventing agent containing layer containing 1.0 g/m$^2$ of gelatin and 1.0 g/m$^2$ of an isomer mixture of 2,5-di-tert-pentadecyl hydroquinones.

Layer (9)′: Same as Layer (6)′.

TABLE 2

| Light-Sensitive Material | | Condition of Storage: Room (25° C., 60% RH) for 3 days Reflective Density 1 hour after processing | | 45° C., 70% RH for 3 days Reflective Density 1 hour after processing | |
|---|---|---|---|---|---|
| | | Maximum Density | Minimum Density | Maximum Density | Minimum Density |
| (I) | Yellow Density | 1.80 | 0.26 | 1.72 | 0.26 |
| | Magenta Density | 1.95 | 0.26 | 1.89 | 0.26 |
| | Cyan Density | 1.84 | 0.29 | 1.82 | 0.29 |
| (II) Comparison | Yellow Density | 1.75 | 0.26 | 1.05 | 0.26 |
| | Magenta Density | 2.02 | 0.26 | 1.40 | 0.26 |
| | Cyan Density | 1.95 | 0.30 | 1.70 | 0.30 |

From the results shown in Table 2, it is apparent that with Light-Sensitive Material (I) according to the present invention stable densities (both maximum and minimum) of yellow magenta and cyan transferred images are obtained while the maximum densities of transferred images markedly decrease under severe storage condition which means unstable with Comparative Light-Sensitive Material (II).

Further, when the cross section of samples which were prepared by storage at 45° C., 70% RH for 3 days Photographic Elements (I) and (II) was observed with a microscope, the boundary of a color mixing preventing agent containing layer and a dye image providing material containing layer was clear in Photographic Element (I). On the contrary, in Photographic Element (II), the boundary of these layers was unclear and it was observed that the mobilization of the hydroquinones used in the dye image providing material containing layer and of the dye image providing materials used in the color mixing preventing agent containing layer occurred.

EXAMPLE 3

Adhesion strength test between interlayer and color forming material containing layer The adhesion strength between layers was determined by measurement of peeling off strength with the case in which the polymer according to the present invention was used (Photographic Element (I)) and the case in which the polymer was not used (Photographic Element (II)) as described in Example 1. The test examples were stored under normal condition (at 25° C., 60% RH) for 7 days or under accelerated condition (at 60° C., 80% RH) for 3 days.

The measurement of peeling off strength was carried out in the following manner.

Measurement Equipment: Instron Tensile Testing Machine

Pulling Speed: 300 m/min

Peeling Off Angle: 180°

Peeling Off Wide: 20 mm

Measurement Condition: 25° C., 60% RH (samples were maintained more than 2 hours prior to measurement)

TABLE 3

Results on Measurement of Peeling Off Strength(3)

| Photographic Element | Condition of Storage (A) | (B) |
|---|---|---|
| (I) | 2.5kg/20mm(1) | 2.5kg/20mm(2) |
| (II) | 1.8kg/20mm | 0.2kg/20mm |

(1)In the photographic element peeling did not occur. Peeling occurred between the photographic element and the adhesive tape.
(2)Same as in (1).
(3)Mean value of 4 times test.

As is apparent from the results shown in Table 3, under this test condition, Photographic Element (I) did not peel off therein and had a strong adhesive strength between the layers, while the peeling easily occurred in Photographic Element (II). When a cross section of Photographic Element (II) after testing was observed with a microscope, it was found that the peeling occurred between the color mixing preventing agent containing layer and the dye releasing redox compound containing layer.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support having thereon at least two silver halide photographic emulsion layers capable of forming a silver image upon treatment with an alkaline processing solution in the presence of a developing agent for silver halide after exposure, said material containing an interlayer to prevent color mixing positioned between said emulsion layers, wherein the improvement comprises an interlayer containing gelatin and a complex which is formed by dissolving a mixture of hydroquinone derivatives having a solidifying point of 100° C. or less in a low boiling point solvent, which are different from the developing agent for silver halide used in the treatment of the material and which do not substantially develop silver halide and a homopolymer or copolymer containing a recurring unit represented by formula (I):

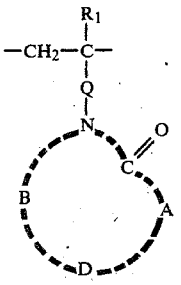

(I)

wherein $R_1$ represents a hydrogen atom or a methyl group; Q represents a chemical bond, —$COOR_2$— or —$CONHR_2$—; A represents a chemical bond or an oxygen atom; B represents a chemical bond or $$-\underset{\underset{O}{\|}}{C}-;$$

D represents $-(CH{=}CH)_2-$ or $-(CH_2)_n-$, wherein n represents an integer of 3 to 5 when A and B are both chemical bonds, an integer of 2 or 3 when A is an oxygen atom and B is a chemical bond, or an integer of 2 to 4 when A is a chemical bond and B is $$-\underset{\underset{O}{\|}}{C}-,$$

or D represents

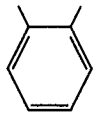

when A is a chemical bond and B is $$-\underset{\underset{O}{\|}}{C}-;$$

and $R_2$ represents a substituted or unsubstituted divalent hydrocarbon group having 2 to 8 carbon atoms.

2. A photographic light-sensitive material as in claim 1 wherein each of said silver halide emulsion layers is associated with a dye releasing redox compound which is capable of releasing a diffusible dye as a result of the redox reaction with an oxidation product of the developing agent for silver halide which is formed upon treatment of the photographic material with an alkali processing solution.

3. A photographic light-sensitive material as in claim 1 wherein each of said silver halide emulsion layers is associated with a color image forming coupler which is capable of forming a dye as a result of the coupling reaction with the oxidation product of the developing agent for silver halide which is formed upon the treatment with an alkali processing solution.

4. A photographic light-sensitive material as in claim 1 wherein said mixture of hydroquinone derivatives has a solidifying point of 60° C. or less.

5. A photographic light-sensitive material as in claim 4 wherein said mixture is liquid or waxen at room temperature.

6. A photographic light-sensitive material as in claim 4 wherein said mixture of hydroquinone derivatives is a mixture of branched chain alkyl hydroquinones.

7. A photographic light-sensitive material as in claim 6 wherein said mixture is an isomer mixture of hydroquinone compounds having tertiary alkyl groups having 15 carbon atoms substituted at the 2- and 5-positions or the 2- and 6-positions of the benzene ring.

8. A photographic light-sensitive material as in claim 6 wherein said mixture is an isomer mixture of secondary dodecyl hydroquinones.

9. A photographic light-sensitive material as in claim 1, wherein said homopolymer or copolymer contains a recurring unit derived from a monomer of an N-vinyl lactam, an N-vinyl imide, an N-acryloyloxyalkyl lactam, an N-acryloyloxyalkyl imide, an N-methacryloyloxyalkyl lactam, an N-methacryloyloxyalkyl imide, an N-(acrylamidoalkyl)lactam, an N-(acrylamidoalkyl)imide, an N-(methacrylamidoalkyl)-lactam, or an N-(methacrylamidoalkyl)imide.

10. A photographic light-sensitive material as in claim 1, wherein said copolymer contains a recurring unit derived from a monomer of an acrylic acid ester, a methacrylic acid ester, an acrylamide, a methacrylamide, an allyl compound, a vinyl ether, a vinyl ester, a vinyl heterocyclic compound, a styrene compound, a maleic acid ester, a fumaric acid ester, an itaconic acid ester, a crotonic acid ester, or an olefin.

11. A photographic light-sensitive material as in claim 1, wherein said homopolymer or copolymer contains a recurring unit derived from a monomer of an N-vinyl lactam, an N-vinyl imide or an N-vinyl oxazolidone.

12. A photographic light-sensitive material as in claim 9, wherein said monomer is N-vinyl pyrrolidone or N-vinyl succinimide.

13. A photographic light-sensitive material as in claim 1, wherein said copolymer contains a recurring unit derived from a monomer of an acrylic acid ester, a methacrylic acid ester, a vinyl ester, an acrylamide or a methacrylamide.

14. A photographic light-sensitive material as in claim 11 wherein said copolymer consists of a recurring unit derived from N-vinyl pyrrolidone and a recurring unit derived from vinyl acetate.

15. A photographic light-sensitive material as in claim 1, wherein recurring units of formula (I) constitute from about 40 to 100 mol % of the homopolymer or copolymer.

16. A photographic light-sensitive material as in claim 1, wherein recurring units of formula (I) constitute from about 70 to 98 mol % of the copolymer.

17. A photographic light-sensitive material as in claim 1, wherein the average molecular weight of the homopolymer or copolymer is from about 10,000 to 1,000,000.

18. A photographic light-sensitive material as in claim 1, wherein the average molecular weight of the homopolymer or copolymer is from about 50,000 to 500,000.

19. A photographic light-sensitive material as in claim 1, wherein the concentration of the mixture of hydroquinone derivative is from about $2\times10^{-4}$ to $1\times10^{-2}$ mol/$m^2$.

20. A photographic light-sensitive material as in claim 1, wherein the concentration of the mixture of hydroquinone derivative is from about $1\times10^{-3}$ to $7\times10^{-3}$ mol/$m^2$.

21. A photographic light-sensitive material as in claim 1, wherein the molar ratio of homopolymer or copolymer/the mixture of hydroquinone derivatives ranges from about 0.05/1 to 5/1.

22. A photographic light-sensitive material as in claim 1, wherein the molar ratio of homopolymer or copolymer/the mixture of hydroquinone derivatives ranges from about 0.2/1 to 2/1.

23. A photographic light-sensitive material as claimed in claim 1, wherein said low-boiling point solvent is selected from the group consisting of ethyl acetate and methyl ethyl ketone.

24. A photographic light-sensitive material as claimed in claim 1, wherein said homopolymer or copolymer is present in an amount less than said gelatin.

25. A photographic light-sensitive material as claimed in claim 23, wherein said low-boiling point solvent is water insoluble.

* * * * *